US008726544B2

(12) United States Patent
Valiyambath Krishnan et al.

(10) Patent No.: US 8,726,544 B2
(45) Date of Patent: May 20, 2014

(54) BOILER HAVING A SECTION FOR PREHEATING WATER

(75) Inventors: Mohankumar Valiyambath Krishnan, Singapore (SG); Hock Soon Tiew, Singapore (SG); Boon Khian Ching, Singapore (SG); Tamilselvan Thirumazhisai Sankaralingam, Singapore (SG); Yen Leng Pang, Singapore (SG); Mo Tan Ng, Singapore (SG); Ajit Pal Singh, Singapore (SG); Asok Kumar Kasevan, Singapore (SG)

(73) Assignee: Koninklijke Philips N.V., Eindhoven (NL)

( * ) Notice: Subject to any disclaimer, the term of this patent is extended or adjusted under 35 U.S.C. 154(b) by 848 days.

(21) Appl. No.: 12/672,318

(22) PCT Filed: Aug. 5, 2008

(86) PCT No.: PCT/IB2008/053117

§ 371 (c)(1),
(2), (4) Date: Feb. 5, 2010

(87) PCT Pub. No.: WO2009/022260

PCT Pub. Date: Feb. 19, 2009

(65) Prior Publication Data

US 2011/0265354 A1 Nov. 3, 2011

(30) Foreign Application Priority Data

Aug. 14, 2007 (EP) ..... 07114333

(51) Int. Cl.
*D06F 75/18* (2006.01)
*D06F 75/00* (2006.01)

(52) U.S. Cl.
USPC ..... 38/77.83; 38/77.9

(58) Field of Classification Search
USPC ..... 38/77.9, 77.82, 77.83, 88, 82; 137/386, 137/395, 571; 122/14.3
See application file for complete search history.

(56) References Cited

U.S. PATENT DOCUMENTS

| | | | | | |
|---|---|---|---|---|---|
| 1,395,624 | A | * | 11/1921 | Young | 417/77 |
| 2,568,104 | A | * | 9/1951 | Young | 38/77.6 |
| 3,686,452 | A | * | 8/1972 | Opiela | 200/84 B |
| 3,802,398 | A | * | 4/1974 | Cancilla et al. | 122/382 |
| 4,206,342 | A | * | 6/1980 | Kuenzli | 392/332 |
| 4,336,825 | A | * | 6/1982 | Pion | 137/403 |
| 4,866,859 | A | * | 9/1989 | Kopelman | 34/526 |

(Continued)

FOREIGN PATENT DOCUMENTS

| | | |
|---|---|---|
| JP | 03267604 | 11/1991 |
| JP | 10089611 | 4/1998 |

*Primary Examiner* — Ismael Izaguirre

(57) ABSTRACT

A boiler having a shell enclosing a space and an inlet for letting water into the shell space. The shell space has two separate sections, wherein a first section is located such as to receive a supply of fresh water to the boiler and wherein a second section is located such as to receive water from the first section when overflow of the first section takes place under the influence of a continuous supply of fresh water. A steam generating process takes place in the second section. Due to the fact that the second section is only indirectly filled with water, it is possible to have an undisturbed process. In particular, the water may be heated in the first section before reaching the second section. The first section may for example include an inner space of a container which is arranged inside the shell, for example.

15 Claims, 4 Drawing Sheets

(56) References Cited

U.S. PATENT DOCUMENTS 4,944,253 A * 7/1990 Bellofatto ..... 122/14.21
4,962,789 A * 10/1990 Benscoter ..... 137/571
5,446,942 A * 9/1995 Whitehorn ..... 15/309.2
5,979,372 A * 11/1999 Park ..... 122/504.2
6,622,404 B2 * 9/2003 Valiyambath ..... 38/96
2008/0310578 A1 * 12/2008 Steltzlen et al. ..... 376/416

* cited by examiner

BOILER HAVING A SECTION FOR PREHEATING WATER

FIELD OF THE INVENTION

The present invention relates to a device comprising a shell which encloses a space for containing a quantity of water that is intended to be heated, and at least one inlet for letting water into the space.

BACKGROUND OF THE INVENTION

A boiler for generating steam by boiling water is a well-known example of a device as mentioned hereinabove. In practice, many types of such boilers are available, and are used in various fields, including fields like steam cleaning and steam ironing.

In many cases, it is desired to have a continuous steam supply. However, when a boiler according to the state of the art is applied, consistency of the steam supply cannot be guaranteed. This is due to the fact that when fresh water is supplied to the boiler in order to replenish water in the boiler during operation of the boiler, a cooling effect on the hot water that is already present in the boiler is obtained. The cooling effect as mentioned may lead to a reduction or even stoppage of the steam output from the boiler.

A reduction of the cooling effect of a supply of fresh water to a quantity of hot water may be obtained in a relatively simple manner, namely by increasing the quantity of hot water. However, this solution involves other disadvantages like an increased startup time and an increased size of the boiler.

SUMMARY OF THE INVENTION

It is an objective of the present invention to provide a boiler which is capable of realizing a consistent steam supply during operation. This objective is achieved by means of a device of which the space for containing water is divided into at least two sections, wherein only a first section is adapted to receive water to be supplied through the inlet during operation, and wherein the first section is adapted to contain a limited quantity of water and allow overflow of water to a second section should the first section be completely filled with water.

In the device according to the present invention, water that is newly supplied to the space enclosed by the shell of the device is first received in the first section of the space. In this way, it is possible to avoid contact of fresh water with a quantity of hot water that is already present in the space, as the hot water may be situated in the second section of the space. The supply of water to the second section exclusively takes place on the basis of overflow of the first section. Water that flows from the first section to the second section may be water that has been in the first section for some time, which is the case when fresh water is supplied to the first section at a position outside the area where the overflow takes place. In such a situation, it is ensured that the water that is supplied to the second section is preheated, as the water has been present in a hot environment for some time, so that the cooling effect of the supply of water is reduced to a considerable extent. The heating process of the water that is present in the first section may be enhanced, for example by associating the first section with heating means of the device.

When the device according to the present invention is used for the purpose of generating steam, it is possible to realize a continuous steam output. In particular, the extent to which water is preheated in the first section may be such that a boiling process of water in the second section is not interrupted in case of an overflow of water from the first section to the second section. An important advantage of the present invention is that the set objective is achieved on the basis of a division of the space for containing water in at least two separate sections, which does not require the application of complex measures. By having an additional quantity of water that is heated up, thus allowing water to be gradually supplied to a quantity of water that is actually used for generating the output of the device on the basis of overflow of a section in which the additional quantity of water is held, thermal stability is enhanced.

Within the scope of the present invention, the division of the space may be realized in any suitable manner. In general, it is very well possible that a wall is arranged inside the space, the wall serving for both forming a partition between the first section and the second section, and partly enclosing the first section. In a preferred embodiment, the wall is thermally connected to the shell, so that it is ensured that the wall is heated to some extent during operation of the device, which contributes to the heating process of water in the first section. The wall may simply be a straight wall which is upright in a normal orientation of the device, but it is also possible that the wall has a totally different shape. For example, the wall may be shaped like the wall of a bowl. In case the wall is heated to a certain extent, the bowl shape contributes to the heating process of water contained inside the bowl, as the surface/volume relation of a bowl is advantageous as far as heating is concerned. The wall may also be shaped like a wall of a tube. A tube also has an advantageous surface/volume relation. When an end portion of the tube extends in an upward direction in a normal orientation of the device, overflow of the tube to the second section of the space for containing water only takes place when the tube is completely filled with water. As water enters the tube at one end and exits the tube at another end, the water is given the opportunity to heat up prior to being supplied to the second section, namely on passing through the tube.

In a practical embodiment, the device according to the present invention comprises at least one element for heating water. In order to enhance the heating process of water that is present in the first section, it is advantageous if the wall which partly encloses the first section is thermally connected to the heating element. Also, it is advantageous if the first section is located at a position which is above the heating element in a normal operational position of the device. In that case, it is possible for water flowing from the first section to fall directly on the heating element, so that a most efficient steam generating process is obtained, as the water supply from the first section is a gradual water supply which only involves relatively small quantities of water.

It is not necessary that a partition between the first section and the second section of the space for containing water is obtained by applying a wall as described hereinabove. For example, it is also possible that a step is arranged in the shell, in particular in a portion of the shell which is at the bottom in a normal orientation of the device. When the bottom is held in an inclined position with respect to the horizontal, two separate sections which are each suitable for containing a quantity of water may be distinguished, thus allowing overflow of water from one section to another to take place at the top side of the step.

For the sake of completeness, it is noted that due to its advantageous features, simple design and, if necessary, relatively small dimensions, the device according to the present invention is particularly suitable to be applied as a domestic steaming device.

The present invention also relates to an assembly comprising a water heating device of which a space for containing water is divided into at least two sections as described in the foregoing, and means for supplying water to said space. Operation of the water supplying means may be controlled by means for sensing the water level in the second section of the space of the water heating device. In particular, when the water level in the second section appears to be lower than a predetermined minimum water level, this will be detected by the sensing and controlling means. At that moment, the sensing and controlling means transmit a signal for operating the water supplying means. As a result, water is supplied to the space of the water heating device, the water being first received in the first section of the space. Water is supplied to the second section of the space as soon as overflow of water from the first section takes place. The operation of the water supplying means is terminated as soon as the water level in the second section is at least at the predetermined level.

In a practical embodiment, the assembly may comprise a water reservoir, a conduit extending from the water reservoir to the inlet of the water heating device, and means for forcing water to flow from the water reservoir to the inlet of the water heating device. It is noted that the latter means may comprise any suitable type of pump, for example. Furthermore, the assembly may comprise a device for letting out steam, such as a steam iron, which is connected to the water heating device through a hose cord. In a preferred embodiment, the device for letting out steam is a boiler type iron, wherein an auto-refill configuration for the boiler is provided using a pump to draw water from a separate or external water tank, so that replenishment of water automatically takes place during operation of the assembly.

The above-described and other aspects of the present invention will be apparent from and elucidated with reference to the following description of a number of embodiments of the device according to the present invention.

BRIEF DESCRIPTION OF THE DRAWINGS

The present invention will now be explained in greater detail with reference to the Figures, in which equal or similar parts are indicated by the same reference signs, and in which.

DETAILED DESCRIPTION OF EMBODIMENTS

Figure 1:
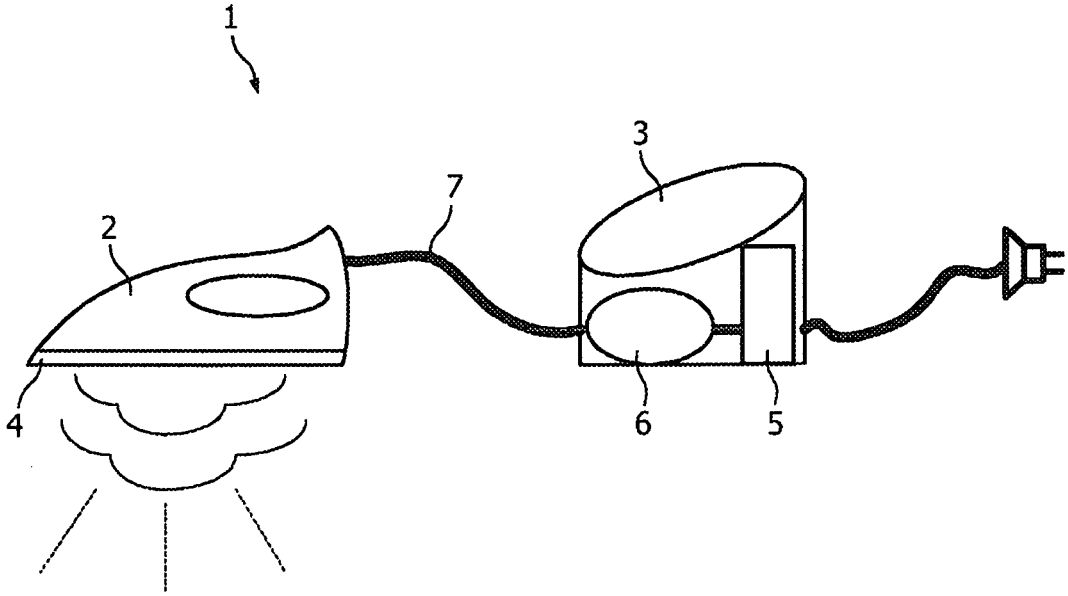
FIG. 1 diagrammatically shows a steam ironing system.

FIG. 1 shows a steam ironing system 1, which comprises a steam iron 2 and a stand 3. The steam iron 2 has a soleplate 4 that is heated during operation, and is capable of supplying steam to objects to be ironed during operation for the purpose of facilitating the ironing process. In the stand 3, a water reservoir 5 and a boiler 6 for heating water to steam are arranged. The steam iron 2 is connected to the boiler 6 through a hose cord 7.

During operation of the steam ironing system 1, the boiler 6 is operated such as to generate steam, and the steam is supplied to the steam iron 2 through the hose cord 7. During the process of steam generation, in order to avoid a situation in which the boiler 6 runs out of water, water is transferred from the water reservoir 5 to the boiler 6.

In many cases it is desired to have a continuous supply of steam. However, it may be difficult to achieve this in practice. Especially when supply of water from the water reservoir 5 to the boiler 6 takes place, there is a chance that the hot water that is already present in the boiler 6 is cooled by the newly supplied water to such an extent that the process of forming steam is interrupted. The present invention proposes measures to avoid such a situation, as will become apparent from the following explanation of a number of embodiments of a boiler 6, which all represent possibilities existing within the scope of the present invention.

Figure 2:
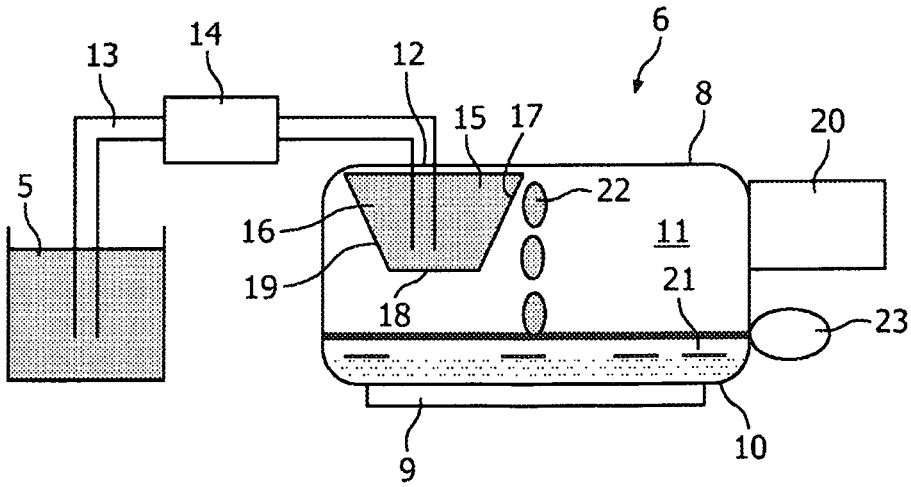
FIG. 2 diagrammatically shows a water reservoir, a water conduit, a pump, and a device according to a first preferred embodiment of the present invention.

FIG. 2 shows a boiler 6 according to a first preferred embodiment of the present invention, which comprises a shell 8 and a heating element 9 arranged against an exterior surface 10 of the shell 8. A space 11 enclosed by the shell 8 is intended to be partly filled with water. In view of this, the boiler 6 has an inlet 12 for letting water into the space 11. Furthermore, FIG. 2 shows a water reservoir 5, a water conduit 13 for transporting water from the water reservoir 5 to the space 11 of the boiler 6, and a pump 14 which is arranged at a position in the water conduit 13, and which serves for forcing water to flow through the water conduit 13 in a predetermined direction, namely in a direction from the water reservoir 5 to the boiler 6.

Inside the space 11 of the boiler 6, a container 15 having a space 16 for containing a limited quantity of water is arranged. For the sake of clarity, in the following, the space 11 enclosed by the shell 8 of the boiler 6 will be referred to as shell space 11, whereas the space 16 of the container 15 will be referred to as container space 16.

In the shown example, the container 15 is shaped like a bowl, wherein a wall 17 of the container 15 comprises a circular bottom portion 18 and an upright, cylindrical portion 19 extending from the circumference of the bottom portion 18 so as to taper in a direction away from (?) the bottom portion 18. The container 15 is arranged right underneath the inlet 12, and the water conduit 13 extends through the inlet 12, wherein an end portion of the water conduit 13 extends inside the container 15, and an open end of the water conduit 13 forms an outlet of the water conduit 13 near the bottom portion 18 of the wall 17 of the container 15.

The boiler 6 is intended to be applied for the purpose of generating steam, and in view of this, the boiler 6 is equipped with a valve 20, preferably an E valve which is arranged at a top side of the shell 8, which is adapted to letting out steam from the shell space 11.

In the following, the operation of the assembly comprising the water reservoir 5, the boiler 6 as shown in FIG. 2, the water conduit 13 and the pump 14 will be explained. During operation, the heating element 9 is operated for generating the heat that is necessary for turning water into steam. The formation of steam takes place by heating a quantity of water that is present in a lower portion 21 of the shell space 11. This quantity of water is obtained by filling the container 15 and allowing for an overflow of the container 15. In FIG. 2, a flow of water from the container 15 to the lower portion 21 of the shell space 11 is represented as a row 22 of droplets.

During the process of steam generation, the water level in the lower portion 21 of the shell space 11 decreases. At a certain moment, it is necessary to replenish the quantity of water. To that end, the pump 14 is operated to transfer water from the water reservoir 5 to the boiler 6. In the process, the water is supplied to the container 15, at the position where the water conduit 13 ends, i.e. close to the bottom portion 18 of the wall 17 of the container 15. When the container 15 is completely filled with water, overflow takes place at the top side of the container 15, so that water flows from the container 15 to the lower portion 21 of the shell space 11.

For the purpose of controlling the water supply by controlling the operation of the pump 14, means 23 which are adapted to function as a level sensor and to transmit operation signals to the pump 14 may be provided, wherein these means 23 may be designed in any suitable way. For example, these means 23 may be designed for detecting a water level by means of a float (not shown), but this is just one of the various possibilities. In any case, the means 23 should be controlling the pump 14 in such a way that the water supply from the water reservoir 5 is started when the water level in the lower portion 21 of the shell space 11 is at or lower than a predetermined minimum, and that the water supply is terminated again when the water level is at or higher than a predetermined maximum.

It is noted that in the shell space 11 of the boiler 6, two separate sections for containing a quantity of water are present, wherein a first section is the container space 16, and a second section is the lower portion 21 of the shell space 11. Only water that is present in the second section 21 is used in the process of generating steam. An important advantage of the present invention resides in the fact that fresh water, i.e. water from the water reservoir 5, is received in the first section 16, and is not allowed to flow directly to the second section 21, so that a process of forming steam is not hindered by a supply of water at a relatively low temperature. It may be said that the first section 16 functions as means for hindering a direct supply of water to the second section 21 on the basis of its capability of holding a certain quantity of water.

Water that is present in the container 15 is preheated on the basis of the fact that the container 15 is located in an environment where hot water and steam are present, and is surrounded by hot elements such as the heating element 9 and the shell 8. By having the outlet of the water conduit 13 located near the bottom portion 18 of the wall 17 of the container 15, there is no possibility for newly supplied water to be instantly taken along in an overflow from the first section 16 to the second section 21, so that it is ensured that only water that has been heated in the container 15 is supplied to the second section 21. In this way, it is possible to have a continuous steam supply, which is advantageous in case of an application of the boiler 6 in a steam ironing system 1 and many other feasible applications.

In order to have an enhanced heating process of the water inside the container 15, the wall 17 of the container 15 may be thermally connected to the shell 8, for example by welding or brazing. With respect to the material of the container 15, it is noted that this may be any suitable material, for example a metal, a silicon material or a plastic.

Figure 3:
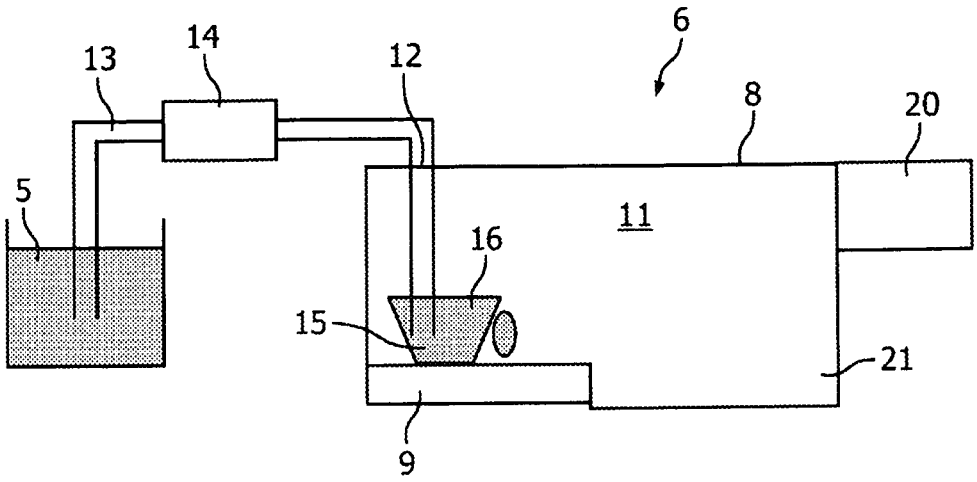
FIG. 3 diagrammatically shows a water reservoir, a water conduit, a pump, and a device according to a second preferred embodiment of the present invention.

FIG. 3 shows a boiler 6 according to a second preferred embodiment of the present invention. In this embodiment, the container 15 is placed directly above the heating element 9, and water overflowing from the container 15 is allowed to fall directly on the heating element 9. In this way, it is achieved that a very effective heating process of the water present inside the container 15 may take place, as this heating process is under direct influence of the heating element 9, and that a very effective steam generating process may take place as well, as this process is performed on the basis of the supply of a relatively small flow of hot water from the container 15, wherein the hot water evaporates shortly after it has hit the heating element 9.

Figure 4:
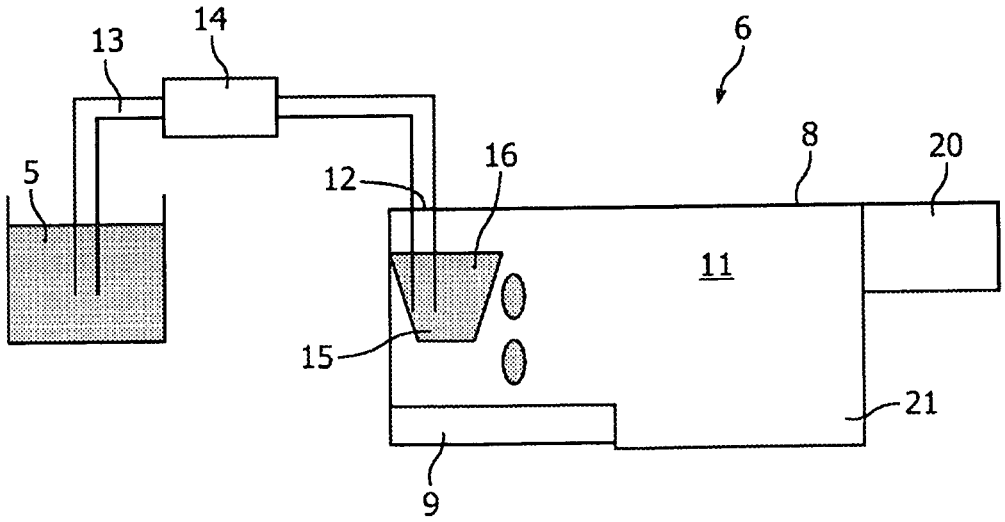
FIG. 4 diagrammatically shows a water reservoir, a water conduit, a pump, and a device according to a third preferred embodiment of the present invention.

It is noted that it is also possible that the container 15 is located at a distance above the heating element 9. This possibility is illustrated by FIG. 4, in which a boiler 6 according to a third preferred embodiment of the present invention is shown.

Figure 5:
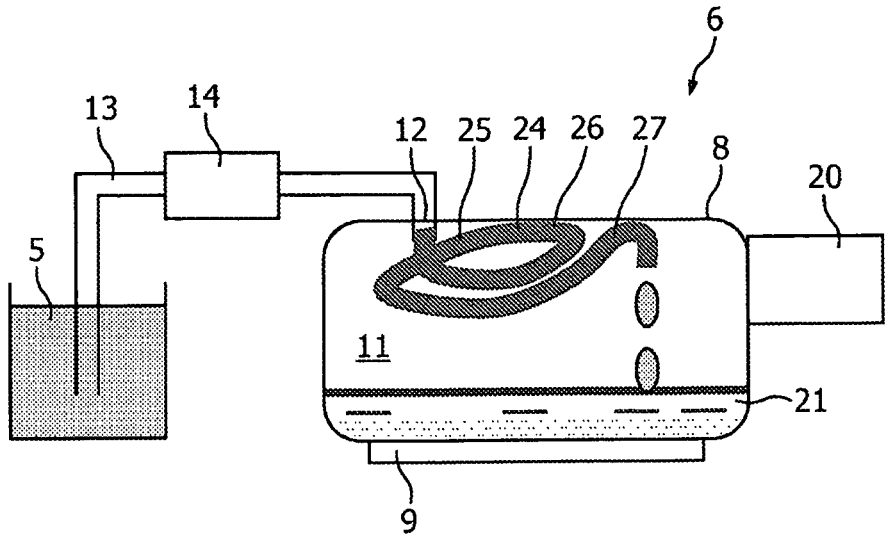
FIG. 5 diagrammatically shows a water reservoir, a water conduit, a pump, and a device according to a fourth preferred embodiment of the present invention.

FIG. 5 shows a boiler 6 according to a fourth preferred embodiment of the present invention. Instead of a bowl-shaped container 15 as shown in FIGS. 2-4, this boiler 6 comprises a tube 24 having a tube wall 25 delimiting an inner space 26 of the tube 24, which is arranged in the shell space 11. Preferably, the tube 24 is coiled and/or bent for compactness. An end portion 27 of the tube 24 is inclined in an upward direction, so that it is only possible for water to flow from the tube 24 when the pump 14 is operated. Only water that has passed through the whole tube 24 is released from the tube 24 when overflow of the tube 24 takes place under the influence of an operation of the pump 14, so that it is ensured that the water that is supplied to the lower portion 21 of the shell space 11 is preheated. For the sake of completeness, it is noted that also in this case, it is advantageous if the tube wall 25 is thermally connected to the shell 8.

Figure 6:
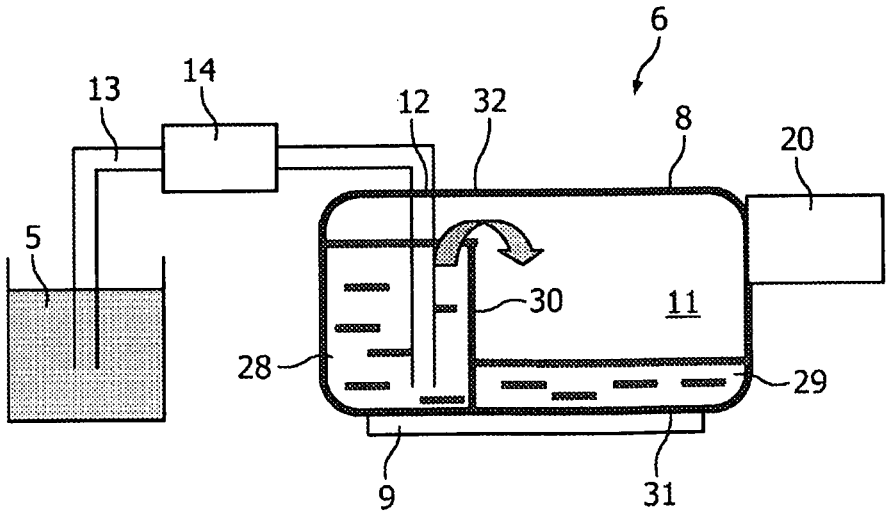
FIG. 6 diagrammatically shows a water reservoir, a water conduit, a pump, and a device according to a fifth preferred embodiment of the present invention.

FIG. 6 shows a boiler 6 according to a fifth preferred embodiment of the present invention. This boiler 6 does not comprise something like a container 15 or a tube 24. Instead, in this boiler 6, two sections 28, 29 of the shell space 11 are created by an upright wall 30, which serves as a partition between the sections 28, 29. The water conduit 13 extends through the inlet 12, wherein an end portion of the water conduit 13 extends inside a first section 28, and an open end of the water conduit 13 is located near a bottom of the first section 28. The wall 30 does not extend all the way from a bottom 31 of the shell 8 to a top 32 of the shell 8, so that there is a possibility of overflow from the first section 28 to the second section 29 at a top of the wall 30. Such an overflow is indicated in FIG. 6 by means of a bent arrow.

Water that is present inside the second section 29 is used in a steam generating process. Supply of water to the second section 29 only takes place in an indirect manner, namely through the first section 28. Fresh water enters the first section 28 near a bottom of the first section 28, and is heated during its stay in the first section 28 and on its way to a top of the first section 28. The heating process of the water in the first section 28 takes place under the influence of various sources of heat, including the heating element 9 which is a primary source of heat, and the shell 8, the wall 30, and the steam that is generated.

Figure 7:
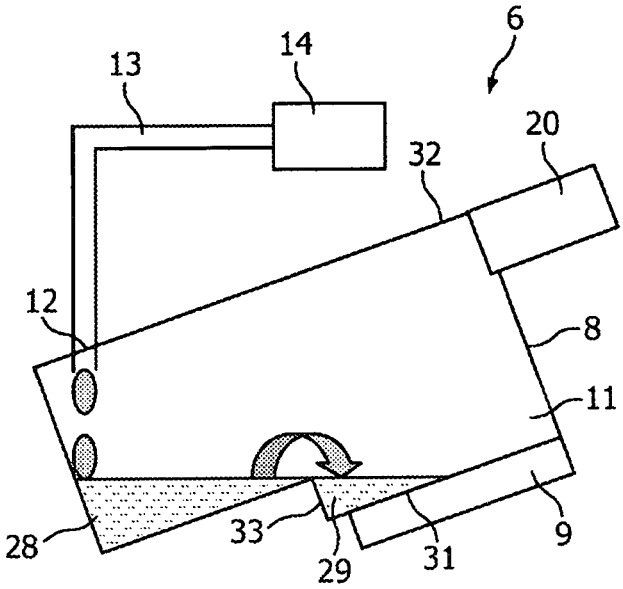
FIG. 7 diagrammatically shows a water conduit, a pump, and a device according to a sixth preferred embodiment of the present invention.

FIG. 7 shows a boiler 6 according to a sixth preferred embodiment of the present invention. It is noted that for the sake of clarity, FIG. 7 only shows a water conduit 13 and a pump 14 besides the boiler 6, wherein the water reservoir 5 is not shown. A special feature of the boiler 6 is that a bottom 31 of the shell 8 is provided with a step 33. Furthermore, the boiler 6 is kept in an inclined orientation, i.e. an orientation in which a bottom 31 and a top 32 of the shell 8 extend in a direction which deviates from the horizontal. Like the embodiment of the boiler 6 shown in FIG. 6, due to the fact that the bottom 31 has an inclined orientation and a step 33 is arranged at the bottom 31, two separate sections 28, 29 which are suitable for containing a quantity of water, are realized.

The inlet 12 is arranged such that water that is supplied to the boiler 6 reaches the first section 28 at a position which is at another side of the first section 28 than the side where the first section 28 adjoins the second section 29. In this way, it is achieved that water which is supplied from the first section 28 to the second section 29 during overflow of the first section 28 is water that has been in the first section 28 for some time and that has been heated as a consequence of a stay in a hot environment. It is noted that like in FIG. 6, an overflow is indicated in FIG. 7 by means of a bent arrow. Overflow takes place as soon as the first section 28 is completely filled with water and the water supply to the boiler 6 is maintained. At that point, water is capable of flowing over the top of the step 33 into the shell bottom 31. In the shown example, the heating element 9 of the boiler 6 is arranged such as to directly heat the second section 29, which is advantageous in view of the fact that a steam generating process is performed in this section 29.

All of the shown embodiments of a boiler 6 according to the present invention have a number of features in common. In particular, in each of the shown embodiments, it is possible to distinguish two separate sections in the shell space 11, wherein a first section 16, 26, 28 is located such as to receive a supply of fresh water to the boiler 6, and a second section 21, 29 is located such as to receive water from the first section 16, 26, 28 when overflow of the first section 16, 26, 28 takes place under the influence of a continuous supply of fresh water. A steam generating process takes place in the second section 21, 29. Due to the fact that the second section 21, 29 is only indirectly filled with water, namely by a flow of water from the first section 16, 26, 28, it is possible to have an undisturbed process. In particular, the water may be heated in the first section 16, 26, 28 first before overflowing into the second section 21, 29. In this respect, it is advantageous if the supply of fresh water to the first section 16, 26, 28 takes place at a distance from an overflow area.

For the purpose of supplying water to the boiler 6, a water conduit 13 and a pump 14 may be applied, wherein the water may be taken from a water reservoir 5. The operation of the pump 14 may be controlled on the basis of a detection of the water level in the second section 21, 29. When the water level drops below a predetermined minimum, the pump 14 is operated until the water level is at an appropriate level again. In the process, the first section 16, 26, 28 is filled with water, such that at a certain point overflow from the first section 16, 26, 28 into the second section 21, 29 occurs.

The first section 16, 26, 28 may comprise an inner space of an actual member for receiving and containing water, which is arranged inside the shell 8 of the boiler 6, such as the shown container 15 or the shown tube 24. However, it is also possible that two sections are created by having a partition at an appropriate position in the shell space 11, wherein the partition may be obtained on the basis of an actual wall 30, or a step 33 in a shell bottom 31, for example.

Summarizing, when the boiler 6 according to the present invention is used for the purpose of delivering steam to another device such as a steam iron 2, the following takes place. When during a steaming process, the boiler 6 demands water, this is supplied to the first section 16, 26, 28 of the shell space 11 of the boiler 6. The water that is already present in the first section 16, 26, 28 is almost at a temperature of the boiler 6. The water that is supplied to the first section 16, 26, 28 displaces a quantity of water in the first section 16, 26, 28, which overflows to a second section 21, 29 of the shell space 11, in which an actual steam generating process takes place under the influence of heating means 9 of the boiler 6. Since the water reaching the second section 21, 29 is already hot, the temperature reduction is minimal, so that a reduction or even interruption of the steam output; which otherwise happens when cold water is directly supplied to the area where the water is boiling and steam is being formed, is avoided.

An advantage of the present invention is that only a division of the shell space 11 of the boiler 6 in two sections is needed for the purpose of guaranteeing continuous steam production. It is not necessary to provide additional means for preheating water before the water is supplied to the section where the actual steam generating process takes place, as use is made of the fact that the shell space 11 constitutes a hot environment.

It will be clear to a person skilled in the art that the scope of the present invention is not limited to the examples discussed in the foregoing, but that several amendments and modifications thereof are possible without deviating from the scope of the present invention as defined in the attached claims. While the present invention has been illustrated and described in detail in the Figures and the description, such illustration and description are to be considered illustrative or exemplary only, and not restrictive. The present invention is not limited to the disclosed embodiments.

Variations to the disclosed embodiments can be understood and effected by a person skilled in the art in practicing the claimed invention, from a study of the Figures, the description and the attached claims. In the claims, the word "comprising" does not exclude other steps or elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the present invention.

The invention claimed is:

1. A water heating device comprising:

a shelf enclosing a first section configured to receive and preheat water and to overflow water in excess of a first quantity, a second section configured to receive the overflow water and to make steam, and a sloping wall forming a partition between the first section and the second section; and at least one inlet for letting the water into the shell.

2. The water heating device according to claim 1, wherein the wall is thermally connected to the shall.

3. The water heating device according to claim 1, wherein the wall forms a bowl.

4. The water heating device according to claim 1, wherein the wall forms a tube connecting the first section to the second section.

5. The water heating device according to claim 1, further comprising a heater thermally connected to the wall for heating the water.

6. The water heating device according to claim 1, further comprising a heater located below the first section for heating the water.

7. The water heating device according to claim 1, the wall comprising a step formed in the shell.

8. The water heating device according to claim 1, wherein the device is configured as a domestic steaming device.

9. The water heating device according to claim 1, further comprising a supply for supplying water.

10. The water heating device according to claim 9, further comprising a sensor configured to sense the water level in the second section and control operation of the supply.

11. The water heating device according to claim 9, further comprising: a water reservoir; a conduit extending from the water reservoir to the inlet; and a pump configured to force water to flow from the water reservoir to the inlet.

12. A steam device for letting out steam, the device comprising:

a water heater including a shell enclosing a preheat section configured to receive and preheat water and to overflow water in excess of a first quantity, and a steam section configured to receive the overflow water and to make steam;

at least one inlet for letting water from a water supply into the shell; and a hose connecting the steam section to the preheating section.

13. The water heating device according to claim 12, wherein the steam device is a steam iron.

14. A water heating device, comprising a shell enclosing a first section configured to receive and preheat water and to overflow water in excess of a first quantity, and a second section configured to receive the overflow water and to make steam;

at least one inlet for letting the water into the shell; and a step formed in the shell.

15. The water heating device according to claim 12, wherein the hose slopes upward between the preheating section and the steam section.

* * * * *